US011107316B2

(12) United States Patent
LeBaron

(10) Patent No.: US 11,107,316 B2
(45) Date of Patent: Aug. 31, 2021

(54) GAMING SYSTEM AND A METHOD OF GAMING

(75) Inventor: Richard G. LeBaron, Las Vegas, NV (US)

(73) Assignee: Aristocrat Technologies Australia Pty Limited

( * ) Notice: Subject to any disclaimer, the term of this patent is extended or adjusted under 35 U.S.C. 154(b) by 841 days.

(21) Appl. No.: 13/049,384

(22) Filed: Mar. 16, 2011

(65) Prior Publication Data

US 2011/0230257 A1 Sep. 22, 2011

Related U.S. Application Data

(60) Provisional application No. 61/315,156, filed on Mar. 18, 2010.

(51) Int. Cl.
*G07F 17/32* (2006.01)

(52) U.S. Cl.
CPC ..... *G07F 17/323* (2013.01); *G07F 17/32* (2013.01); *G07F 17/3237* (2013.01); *G07F 17/3239* (2013.01)

(58) Field of Classification Search
CPC .... G07F 17/32; G07F 17/323; G07F 17/3237; G07F 17/3239; G07F 17/3274; G07F 17/3281
USPC ..... 463/25
See application file for complete search history.

(56) References Cited

U.S. PATENT DOCUMENTS 3,759,521 A 9/1973 Breslow et al.
4,012,045 A 3/1977 Vail
5,035,423 A 7/1991 Arciniega
5,064,200 A 11/1991 Martinez
5,066,015 A 11/1991 Sumrall
5,377,973 A 1/1995 Jones et al.
5,390,913 A 2/1995 Kepler
5,439,229 A 8/1995 Kaiser
5,494,284 A 2/1996 Wray, Jr.
5,643,094 A 7/1997 Macri et al.
5,741,194 A 4/1998 Simunek
5,752,886 A 5/1998 Tien
5,899,810 A 5/1999 Smith
5,909,875 A 6/1999 Weingardt
6,189,886 B1 2/2001 Moran
6,336,876 B1 1/2002 Moore
(Continued)

FOREIGN PATENT DOCUMENTS

CA 1206986 A1 7/1988
CH 672436 A5 11/1989
(Continued)

*Primary Examiner* — Werner G Garner

(74) *Attorney, Agent, or Firm* — McAndrews, Held & Malloy, Ltd.

(57) ABSTRACT

A gaming system is disclosed that comprises a game play monitor arranged to monitor game play data associated with a player during game play, and a reward controller arranged to maintain a game player data target associated with at least one player. The system is arranged to maintain a current game play data total such that the game play data total accumulates in response to detection of game play data by the game play monitor, and to determine whether to allocate a reward to the at least one player based on the current game play data total and the game play data target. A corresponding method is also disclosed.

27 Claims, 8 Drawing Sheets

(56) References Cited

U.S. PATENT DOCUMENTS

| | | | | |
|---|---|---|---|---|
| 6,371,848 | B1 | 4/2002 | Ashby | |
| 6,416,409 | B1 | 7/2002 | Jordan | |
| 6,598,876 | B1 | 7/2003 | Pierce et al. | |
| 6,655,686 | B1 | 12/2003 | Morgan | |
| 6,932,340 | B1 | 8/2005 | Schaefer et al. | |
| 6,979,000 | B1 | 12/2005 | Vahala | |
| 7,050,039 | B1 | 5/2006 | McGloin et al. | |
| 2002/0130466 | A1 | 9/2002 | Callaway, Jr. | |
| 2002/0183108 | A1 | 12/2002 | Baeg | |
| 2003/0008268 | A1 | 1/2003 | Thomas | |
| 2003/0054869 | A1 | 3/2003 | Hightower | |
| 2004/0242297 | A1* | 12/2004 | Walker et al. | 463/13 |
| 2004/0267386 | A1 | 12/2004 | Hightower | |
| 2005/0064933 | A1 | 3/2005 | Davis | |
| 2006/0166731 | A1* | 7/2006 | Yoshimi et al. | 463/20 |
| 2006/0189370 | A1 | 8/2006 | Baerlocher et al. | |
| 2006/0189416 | A1 | 8/2006 | Nelson | |
| 2006/0199630 | A1 | 9/2006 | Reiner et al. | |
| 2006/0227098 | A1 | 10/2006 | Seldomridge | |
| 2006/0252530 | A1* | 11/2006 | Oberberger et al. | 463/29 |
| 2006/0287077 | A1 | 12/2006 | Gray et al. | |
| 2007/0015571 | A1* | 1/2007 | Walker et al. | 463/25 |
| 2007/0045954 | A1 | 3/2007 | DeLaCruz-Newlan | |
| 2007/0129132 | A1 | 6/2007 | Seelig et al. | |
| 2007/0155466 | A1 | 7/2007 | Baerlocher et al. | |
| 2007/0218983 | A1 | 9/2007 | Lombardo | |
| 2007/0281784 | A1 | 12/2007 | Seelig et al. | |
| 2008/0015011 | A1 | 1/2008 | Gauselmann | |
| 2008/0045315 | A1 | 2/2008 | Kojima | |
| 2008/0045316 | A1 | 2/2008 | Kojima | |
| 2008/0046953 | A1 | 2/2008 | Kossila | |
| 2008/0113760 | A1 | 5/2008 | Baerlocher | |
| 2008/0146316 | A1 | 6/2008 | Yoshizawa | |
| 2008/0153585 | A1* | 6/2008 | Packes et al. | 463/25 |
| 2008/0211179 | A1 | 9/2008 | Kelly | |
| 2008/0265506 | A1 | 10/2008 | Benedict | |
| 2009/0048010 | A1* | 2/2009 | Kroeckel et al. | 463/13 |
| 2009/0058007 | A1 | 3/2009 | Neverdahl | |
| 2009/0082099 | A1* | 3/2009 | Luciano et al. | 463/26 |
| 2009/0098927 | A1 | 4/2009 | Nishmura et al. | |
| 2009/0117990 | A1 | 5/2009 | Englman et al. | |
| 2009/0117993 | A1 | 5/2009 | Bigelow, Jr. et al. | |
| 2009/0124320 | A1* | 5/2009 | DeWaal | 463/16 |
| 2009/0124363 | A1* | 5/2009 | Baerlocher | G07F 17/32 463/27 |
| 2009/0170588 | A1 | 7/2009 | Baerlocher | |
| 2009/0191931 | A1 | 7/2009 | Peck | |
| 2009/0191937 | A1 | 7/2009 | Sum et al. | |
| 2009/0209329 | A1 | 8/2009 | Soukup et al. | |
| 2009/0209330 | A1 | 8/2009 | Soukup et al. | |
| 2009/0209332 | A1 | 8/2009 | Soukup et al. | |
| 2009/0226870 | A1 | 9/2009 | Minotti | |
| 2009/0247267 | A1* | 10/2009 | Acres | 463/20 |
| 2009/0286586 | A1 | 11/2009 | Heymann et al. | |
| 2009/0311653 | A1 | 12/2009 | Kim | |
| 2010/0004044 | A1 | 1/2010 | Slomiany | |
| 2011/0092271 | A1* | 4/2011 | Nguyen | G07F 17/3244 463/25 |

FOREIGN PATENT DOCUMENTS

| | | | |
|---|---|---|---|
| CN | 2065499 | U | 11/1990 |
| CN | 1085818 | A | 4/1994 |
| CN | 2463007 | Y | 12/2001 |
| CN | 2724790 | Y | 9/2005 |
| CN | 2728575 | Y | 9/2005 |
| CN | 2749547 | Y | 1/2006 |
| CN | 2761232 | Y | 3/2006 |
| CN | 2841096 | Y | 11/2006 |
| CN | 101422649 | A | 5/2009 |
| CN | 101425160 | A | 5/2009 |
| DE | 3141540 | A1 | 5/1983 |
| DE | 10107931 | A1 | 9/2002 |
| EP | 0490699 | A2 | 6/1992 |
| EP | 0521468 | A1 | 1/1993 |
| EP | 0931572 | A2 | 7/1999 |
| EP | 1811477 | A1 | 7/2007 |
| EP | 1889644 | A1 | 2/2008 |
| GB | 190917628 | A | 4/1910 |
| GB | 189600 | A | 12/1922 |
| GB | 202855 | A | 8/1923 |
| GB | 465448 | A | 5/1937 |
| GB | 627951 | A | 8/1949 |
| GB | 639443 | A | 6/1950 |
| GB | 648113 | A | 12/1950 |
| GB | 680713 | A | 10/1952 |
| GB | 849260 | A | 9/1960 |
| GB | 1229832 | A | 4/1971 |
| GB | 1308827 | A | 3/1973 |
| GB | 2154455 | A | 9/1985 |
| GB | 2226500 | A | 4/1990 |
| GB | 2299952 | A | 10/1996 |
| GB | 2312851 | A | 11/1997 |
| GB | 2313792 | A | 12/1997 |
| GB | 2345644 | A | 7/2000 |
| GB | 2352641 | A | 7/2001 |
| GB | 2420989 | A | 6/2006 |
| JP | 3171124 | A | 7/1991 |
| JP | 3295573 | A | 12/1991 |
| JP | 6178866 | A | 6/1994 |
| JP | 6319872 | A | 11/1994 |
| JP | 7008598 | A | 1/1995 |
| JP | 9047574 | A | 2/1997 |
| JP | 11300024 | A | 11/1999 |
| JP | 2000350856 | A | 12/2000 |
| JP | 2001058084 | A | 3/2001 |
| JP | 2001204967 | A | 7/2001 |
| JP | 2006102123 | A | 4/2006 |
| JP | 2006340976 | A | 12/2006 |
| JP | 2007319301 | A | 12/2007 |
| JP | 2007319562 | A | 12/2007 |
| JP | 2007325740 | A | 12/2007 |
| JP | 200861736 | A | 3/2008 |
| JP | 2008148810 | A | 7/2008 |
| JP | 2008183115 | A | 8/2008 |
| JP | 2008245881 | A | 10/2008 |
| JP | 2008295635 | A | 12/2008 |
| JP | 200956169 | A | 3/2009 |
| KR | 20040010886 | A | 2/2002 |
| KR | 20020047065 | A | 6/2002 |
| KR | 20020085540 | A | 11/2002 |
| RU | 2284571 | C1 | 9/2006 |
| WO | 9521665 | A1 | 8/1995 |
| WO | 9805394 | A1 | 2/1998 |
| WO | 0105475 | A1 | 1/2001 |
| WO | 01/10523 | A1 | 2/2001 |
| WO | 0199067 | A2 | 12/2001 |
| WO | 03055565 | A1 | 7/2003 |
| WO | 2008011600 | A2 | 1/2008 |
| WO | 2008134795 | A1 | 11/2008 |
| WO | 2008141378 | A1 | 11/2008 |
| WO | 2008151172 | A2 | 12/2008 |
| WO | 2009052380 | A1 | 4/2009 |

* cited by examiner

GAMING SYSTEM AND A METHOD OF GAMING

RELATED APPLICATIONS

This application claims priority from U.S. Provisional Patent Application Ser. No. 61/315,156, filed Mar. 18, 2010, the entire content of which is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly display several symbols from a predetermined set of symbols and to determine a game outcome such as a game win based on the displayed symbols. In some arrangements, a win outcome is defined on the basis of occurrence of symbols along defined win lines which may be preselected or selected by a player prior to display of symbols by the gaming system.

Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

- a game play monitor arranged to monitor game play data associated with a player during game play; and
- a reward controller arranged to maintain a game player data target associated with at least one player;
- the system being arranged to maintain a current game play data total such that the game play data total accumulates in response to detection of game play data by the game play monitor; and
- the system being arranged to determine whether to allocate a reward to the at least one player based on the current game play data total and the game play data target.

In one embodiment, the reward controller is locally disposed relative to the game play monitor.

In an alternative embodiment, the reward controller is disposed remotely relative to the game play monitor, for example in networked communication with the game play monitor, such as through the Internet.

In one arrangement, the reward controller is arranged to maintain the current game play total.

In one embodiment, the reward controller is arranged to allocate a reward to the at least one player when the current game play data total equals or exceeds the game play data target.

In one embodiment, the gaming system comprises at least one display arranged to display information indicative of progress towards the game play data target using the current game play data total and the game play data target.

In one embodiment, the information indicative of progress towards the game play data target using the current game play data total and the game play data target is displayed to a player by displaying a progress indicator, such as a representation of a thermometer.

In one embodiment, the gaming system comprises a timer and the gaming system is arranged to maintain a time limit and to allocate a reward to the at least one player only if a determination is made to allocate a reward before expiration of the time limit.

In one embodiment, the gaming system is arranged to display information indicative of the amount of time available to equal or exceed the game play data target.

The information indicative of the amount of time available to equal or exceed the game play data target may be displayed to a player by displaying a time indicator, such as a representation of an analogue and/or digital timer.

In one embodiment, the gaming system comprises a common display arranged to display information indicative of the progress towards the game play data target and/or the time available to equal or exceed the game play data target and thereby receive an award.

In one embodiment, the gaming system comprises at least one gaming machine having at least one display.

In one embodiment, at least one gaming machine display is disposed on a top box of a respective gaming machine or incorporated into a player marketing module of the gaming machine.

In one embodiment, each player has an associated individual current game play data total and individual game play data target.

In an alternative embodiment, a group of players have an associated group current game play data total and group game play data target.

In an alternative embodiment, a group of players have an associated group game play data target and each player in the group has an individual current game play data total.

In one embodiment, the group of player is defined according to location, type of gaming machine played, randomly or based on a designated membership level which may be based on past game play activity.

The game play data may comprise total amount of coin in, coin loss, game points earned or velocity of play.

In one embodiment, the award may comprise show tickets, hotel room bookings, clothing, health club visits or monetary amounts.

The gaming system may be implemented as a stand alone gaming machine or across a network.

In one embodiment, one or more of the game play monitor and the reward controller is constituted, at least in part, by a processor executing program code stored in a memory.

In one embodiment, the gaming system comprises a game play mechanism operable to place a wager and the outcome evaluator evaluates the outcome based on the wager.

In accordance with a second aspect of the present invention, there is provided a method of gaming comprising:

- monitoring game play data associated with a player during game play; and
- maintaining a game player data target associated with at least one player;
- maintaining a current game play data total such that the game play data total accumulates in response to detection of game play data by the game play monitor; and determine whether to allocate a reward to the at least one player based on the current game play data total and the game play data target.

In accordance with a third aspect of the present invention, there is provided a computer program arranged when loaded into a computer to instruct the computer to operate in accordance with a gaming system according to the first aspect of the present invention.

In accordance with a fourth aspect of the present invention, there is provided a computer readable medium having computer readable program code embodied therein for causing a computer to operate in accordance with a gaming system according to the first aspect of the present invention.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

The present gaming system operates so as to reward a player or group of players for game play loyalty. A game play data target is defined and the system maintains a game play data running total, for example indicative of the total amount of game play by the player or group of players, such as the total amount of coin in, coin loss, game points earned, velocity of play, and so on, and a prize is awarded based on a comparison between the game play data target and the game play data running total. For example, when the game play data running total reaches or exceeds the game play data target, the player or group of players are awarded a prize. The system may also be arranged to define a time limit for reaching the target such that a prize is only awarded if the target is reached within the defined time limit.

In the present embodiment, the gaming system is arranged to implement a game using a set of symbols. During the game, several symbols are selected from the set of symbols, and when a defined combination of symbols occurs a prize is awarded.

The system may have a single mode of operation or may be of the type including multiple game modes such as operable in normal game mode wherein a base game is implemented and special game mode wherein a feature game is implemented.

With some such probabilistic games, the set of symbols used during normal game mode include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Figure 1:
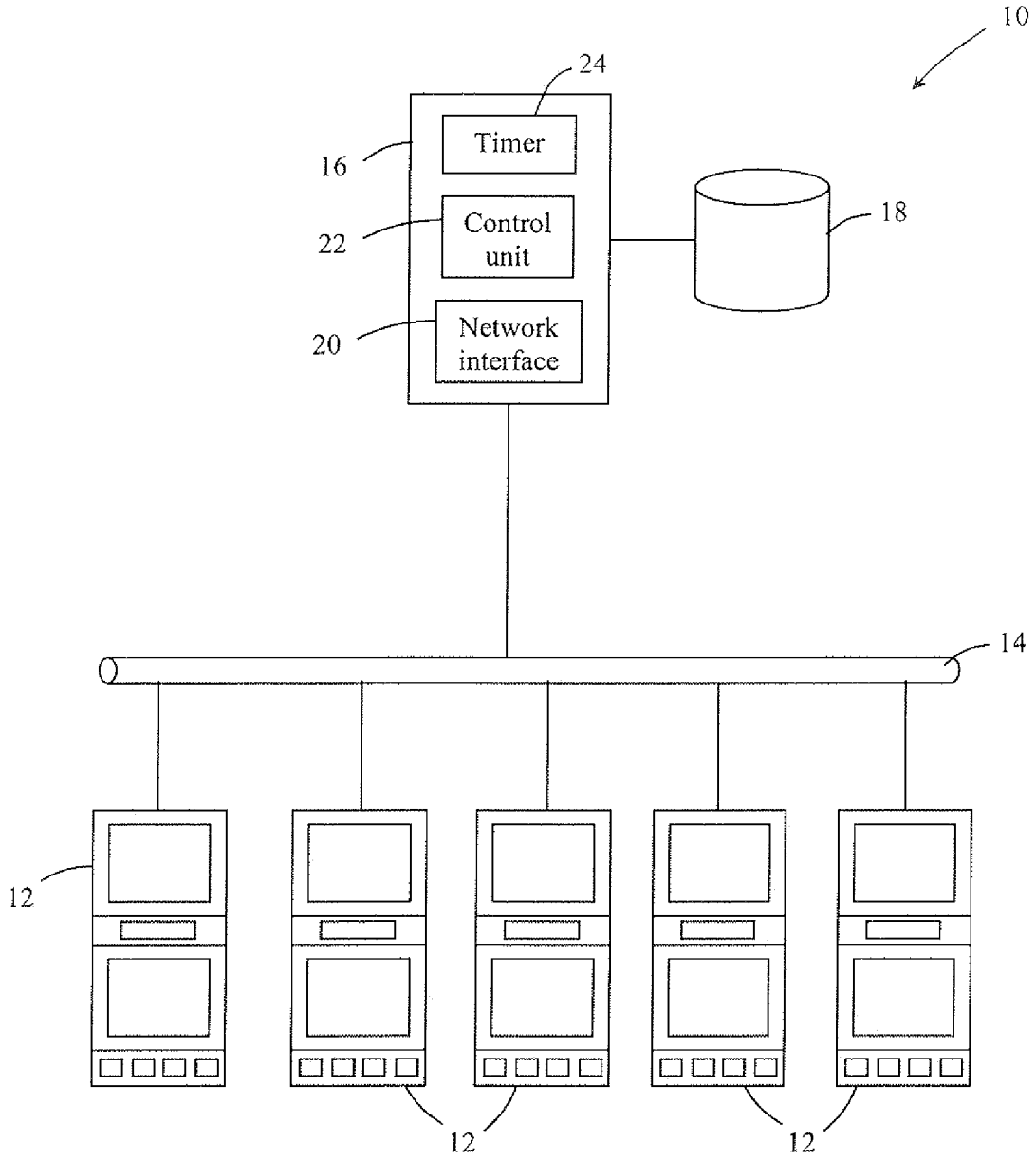
FIG. 1 is a schematic diagram of a gaming system in accordance with an embodiment of the present invention.

Referring to FIG. 1, there is shown a gaming system 10 of a type implemented across a network. The gaming system 10 comprises a plurality of gaming devices 12, in this example in the form of stand alone gaming machines arranged to implement a game at the gaming machine. The gaming machines 12 are connected through a network 14, for example a network including the Internet, to a remote reward controller 16 arranged to control and coordinate awarding of a reward to one or more players based on game play criteria. The gaming machines 12 may be disposed at the same location, for example at the same gaming venue, or may be disposed at different locations. It will also be understood that although five gaming machines 12 are shown in FIG. 1, any number of gaming machines 12 may be provided, with the gaming machines disposed at the same or different gaming venues.

The reward controller 16 is associated with a data storage device 18, for example in the form of a database, arranged to store information indicative of one or more game play data targets and one or more current game play data totals. In one embodiment, each player has an associated game play data target and an associated current game play data total. In another embodiment, designated groups of players may have an associated game play data target and an associated current game play data total such that game play data derived from any of the players of the group contribute to the current game play data total. In a further embodiment, a designated group of players has an associated game play data target and each player of the group of players has a respective current game play data total.

The reward controller 16 comprises a network interface 20 arranged to facilitate communications with the network 14 and thereby with the gaming machines 12, and a control unit 22 for controlling and coordinating operations in the reward controller 16, in particular for managing storage of game play data targets in the database 18, managing storage and updating of current game play data totals in the database 18 based on game play data information received from the gaming machines 12, managing storage of time limits for reaching game play data targets, and determining whether a reward should be allocated to a player or group of players based on a comparison between a current game play data total and an associated game play data target.

The reward controller 16 also includes a timer 24 arranged to maintain an accumulating time value, and the control unit 22 is arranged to compare the time value with an associated stored time limit to determine whether time is still available for a player or group of players to reach a game play target.

The game play data targets, the current game play data totals, the time limits and the current time values are used by the gaming system to communicate to the or each associated player the progress towards the relevant game play data target and the amount of time available to reach the target, for example by displaying information on a display of the gaming machines 12, as described in more detail below.

Figure 2:
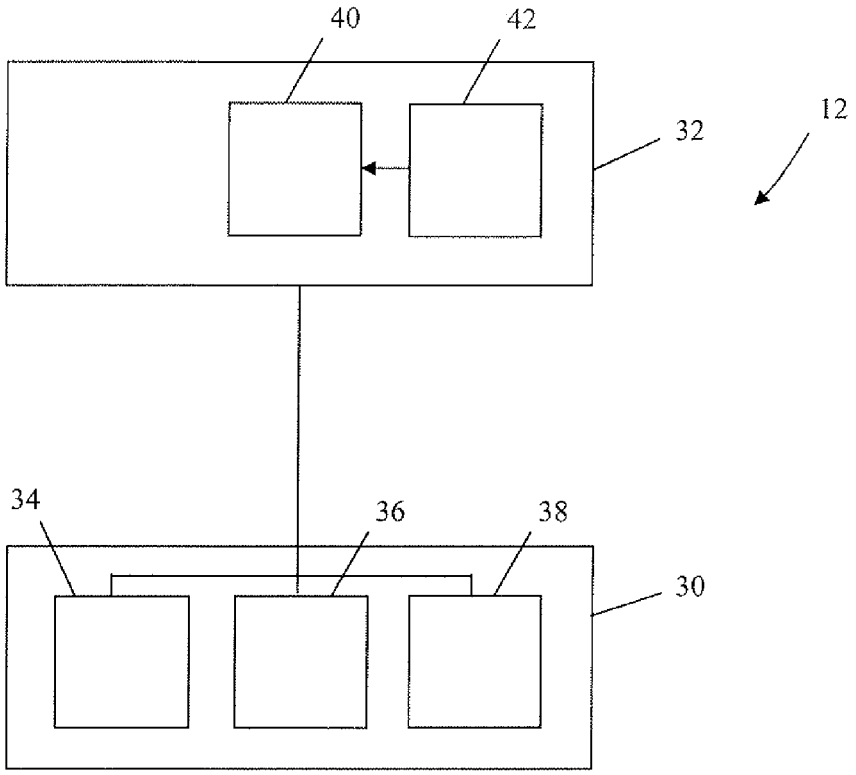
FIG. 2 is a schematic block diagram of core components of a gaming system in accordance with an embodiment of the present invention.

Referring to FIG. 2, a schematic diagram of core components of an example gaming machine 12 is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game play instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 3:
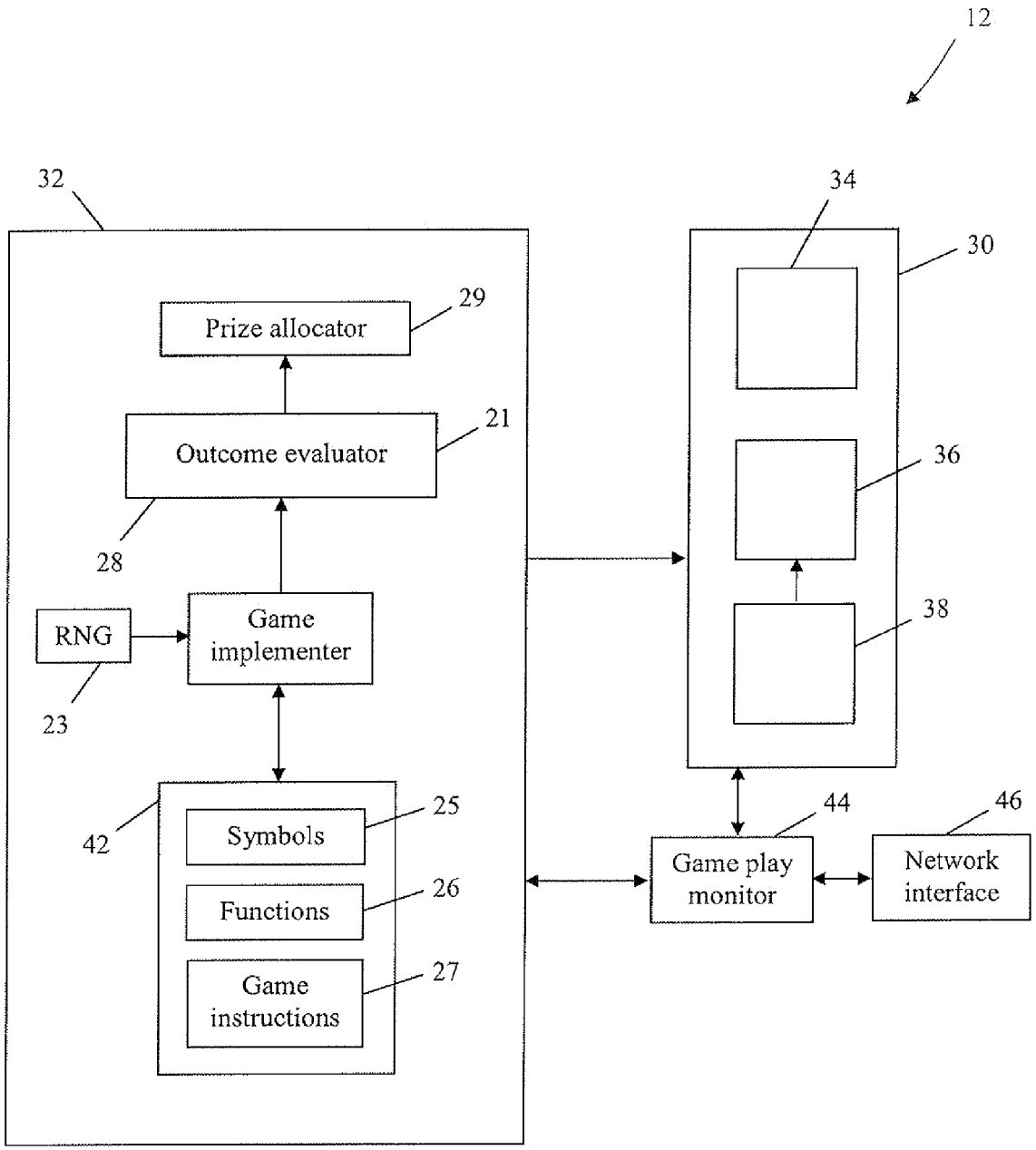
FIG. 3 is a schematic block diagram of functional components of a gaming system in accordance with an embodiment of the present invention.

A functional diagram illustrating operative components of a gaming machine 12 of the gaming system 10 is shown in FIG. 3.

The memory 42 is arranged to store symbols data 25 indicative of a plurality of symbols used during a game, in the present example associated with a plurality of reels, function data 26 indicative of one or more functions allocatable to the symbols, and game instruction data 27 indicative of game instructions usable by the gaming machine 12 to control operation of the game.

The game controller 32 includes a game implementer 21 which is arranged to select several symbols from the symbols 25 for display to a player in a plurality of display positions, in this example by spinning reels containing the symbols and stopping the reels so as to display at least one symbol on each reel. In this example, the selection carried out by the game implementer 21 is made using a random number generator 23. The selected symbols are communicated to a display controller which controls a display so that the selected symbols are displayed in a display area.

It will be appreciated that the random number generator 23 may be of a type which is arranged to generate pseudo random numbers based on a seed number, and that in this specification the term "random" will be understood accordingly to mean truly random or pseudo random.

The game controller 32 also comprises an outcome evaluator 28 which in accordance with the game instructions 27 determines game outcomes based on the symbols selected for display to the player by the game implementer 21.

The game controller 32 also comprises a prize allocator 29 arranged to allocate a prize to a player when a winning outcome exists, the type of prize being dependent on the winning outcome.

The gaming machine 12 also comprises a game play monitor 44 arranged to monitor the gaming machine for game play data relevant to the game play data target, and to communicate obtained game play data to the reward controller 16 using a suitable network interface 46. In this example, the game play data comprises data indicative of the total amount of coin in, coin loss, game points earned and/or velocity of play. The network interface 46 is also arranged to receive information indicative of progress towards the game play data target and indicative of the remaining time available to reach the game play data target, and to pass the information to the game controller for display to a player.

In the embodiments described below, the game implementer 21, the outcome evaluator 28, the prize allocator 29, and the game play monitor 44 are at least partly implemented using the processor 40 and associated software, although it will be understood that other implementations are envisaged.

The gaming system 10 can take a number of different forms.

In a first form, a stand alone gaming machine is provided wherein all or most components required for implementing the gaming system are present in a player operable gaming machine.

In a second form, a distributed architecture is provided wherein some of the components required for implementing the gaming system are present in a player operable gaming device and some of the components required for implementing the gaming system are located remotely relative to the gaming device.

For example, in relation to implementation of a game, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a gaming server and the respective functions of the gaming device and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Similarly, implementations are envisaged wherein the reward controller is not remotely located relative to the gaming machine but instead is incorporated into each gaming machine.

Figure 4:
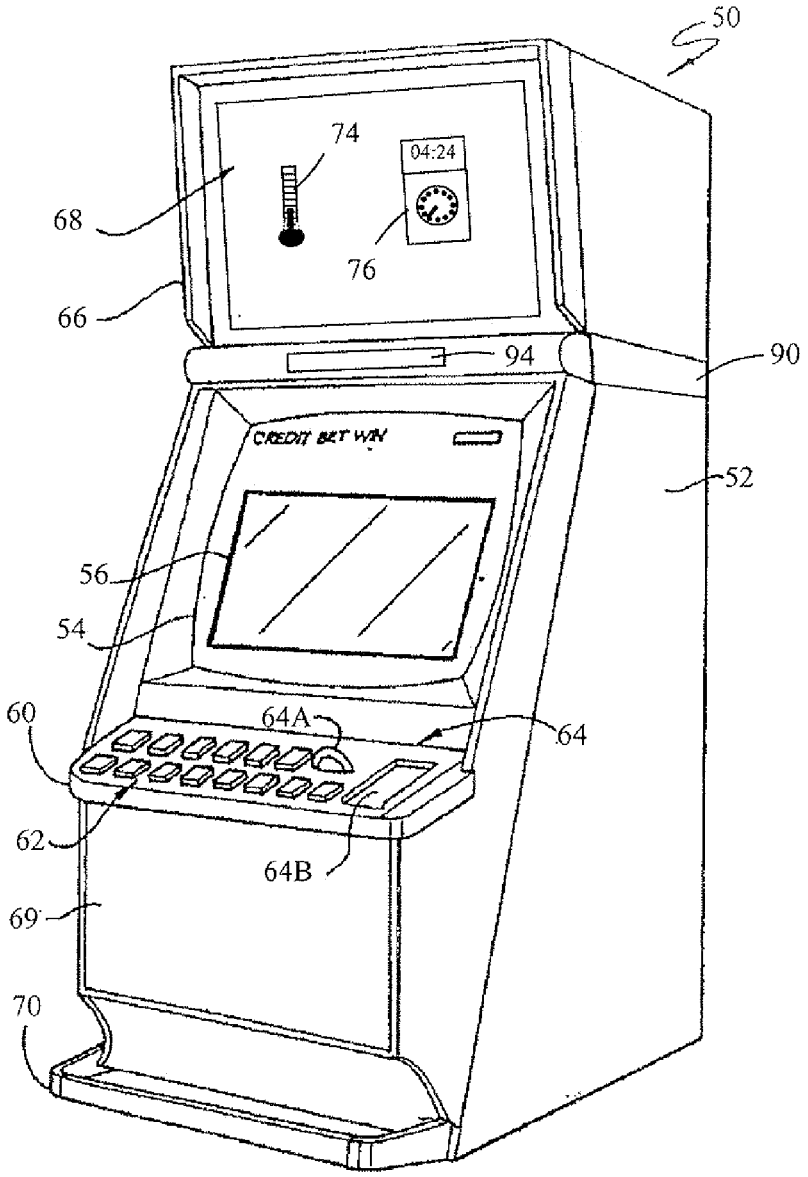
FIG. 4 is a diagrammatic representation of a gaming machine in accordance with an embodiment of the present invention.

A gaming machine 12 of the gaming system 10 is illustrated in FIG. 4. The gaming machine 50 includes a console 52 having a primary display 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 includes a secondary display 68 used to display information indicative of progress towards a game play data target and information indicative of the time available to achieve the game play target. In this example, a progress visual indicator in the form of a thermometer 74 and a timer visual indicator in the form of analogue and digital timers 76 are displayed.

Artwork and/or information may be provided on a front panel 69 of the console 52. A coin tray 70 is mounted beneath the front panel 69 for dispensing cash payouts from the gaming machine 50.

The primary and secondary displays 54, 68 are each in the form of a video display unit, particularly a cathode ray tube screen device. Alternatively, the displays 54, 68 may each be a liquid crystal display, plasma screen, or any other suitable video display unit. The display 54 may also comprise a touch screen usable by a player to interact with the gaming machine.

The primary display 54 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

Figure 5:
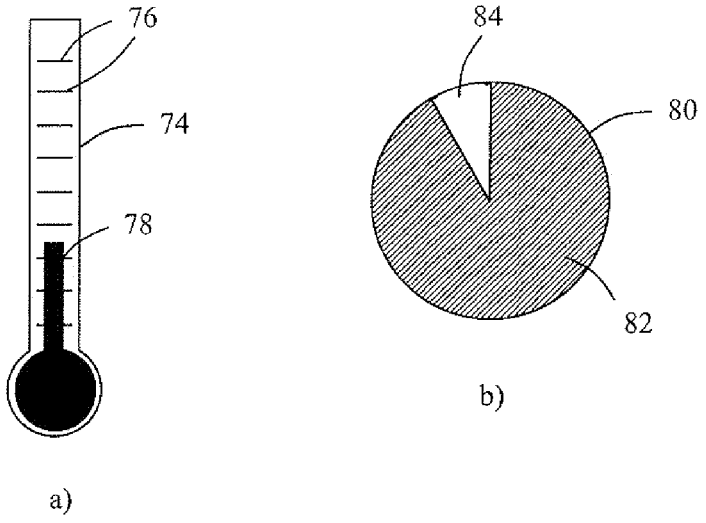
FIGS. 5*a* and 5*b* illustrate example play data visual indicators representing progress towards a game play data target.

The thermometer progress visual indicator 74 is shown more particularly in FIG. 5*a*. The visual indicator 74 includes a plurality of marker lines 76, and a progress bar 78 the position of which relative to the marker lines 76 indicates progress towards the game play data target.

An alternative progress visual indicator 80 is shown in FIG. 5*b*. The progress visual indicator 80 is in the form of a pie diagram having 2 sections 82, 84, the size of the first section 82 relative to the pie 80 indicating the level of progress towards the play data target, and the size of the second section 84 indicating how close the player is to reaching the play data target.

Figure 6:
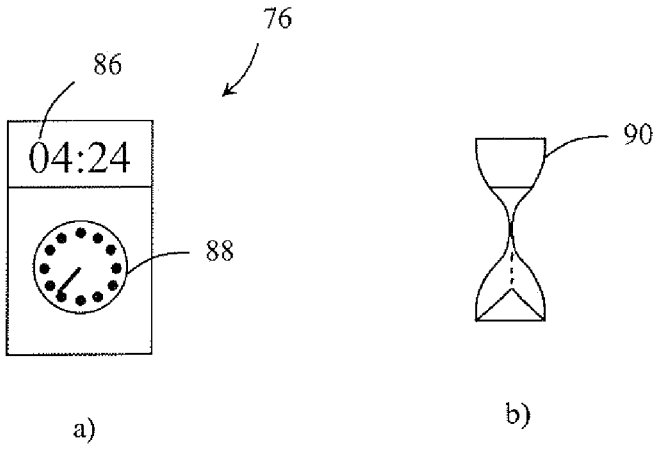
FIGS. 6*a* and 6*b* illustrate example timer visual indicators representing the time available to read the game play data target.

The timer visual indicator 76 is shown more particularly in FIG. 6*a*. The timer visual indicator 76 includes a digital time indicator 86 and an analogue time indicator 88 indicative of the amount of time left in which to reach the game play data target.

An alternative time visual indicator 90 in the form of an eggtimer is shown in FIG. 6*b*.

It will be understood that any suitable progress indicator and time indicator is envisaged, the important aspect being that the level of progress towards a game play data target and the amount of time available to the player to achieve the play data target are clearly communicated to the player.

A player marketing module (PMM) 90 having a display 94 is connected to the gaming machine 50. The main purpose of the PMM 92 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 90 is a Sentinel III device produced by Aristocrat Technologies Pty Ltd.

Figure 7:
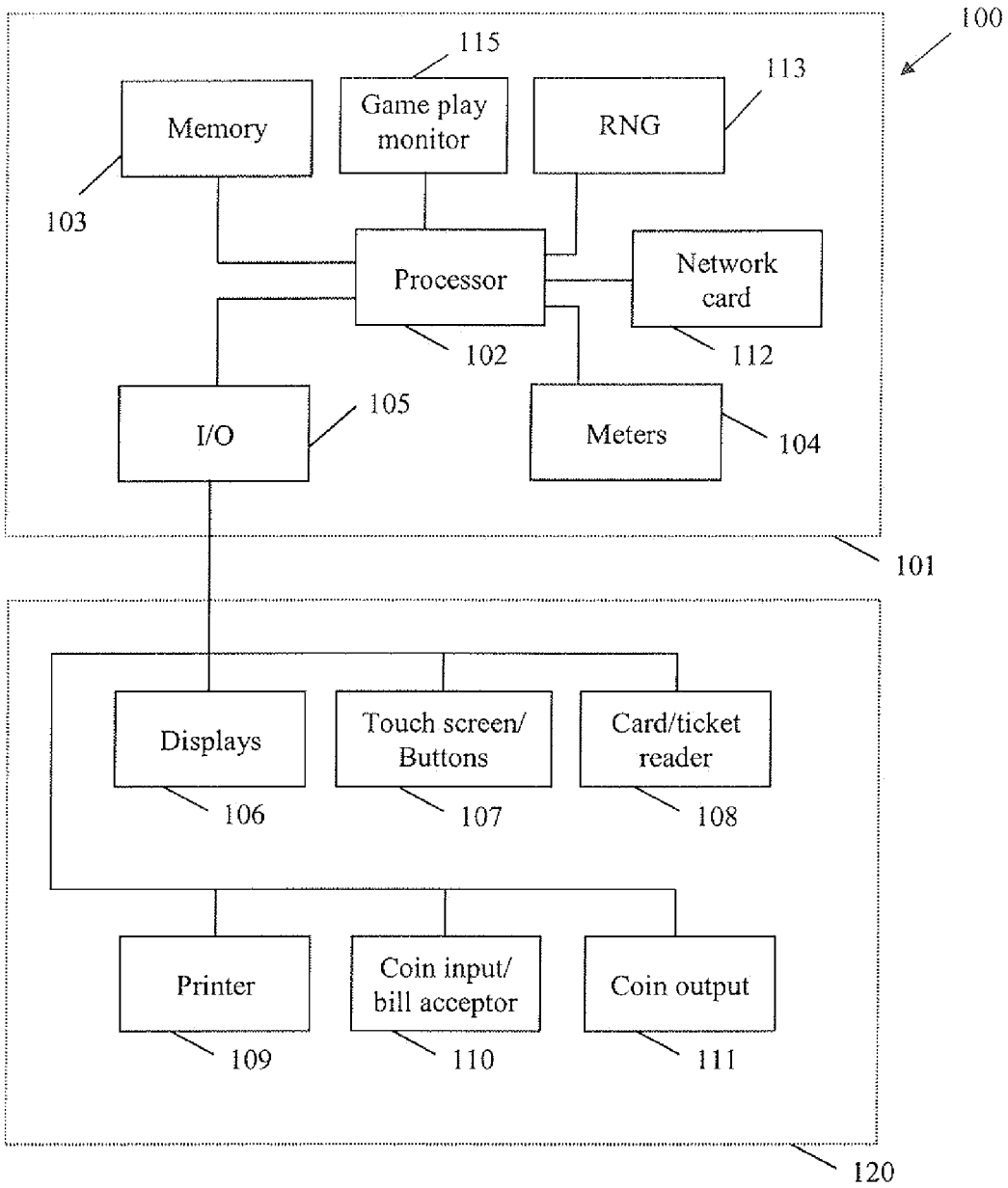
FIG. 7 is a schematic block diagram of operative components of the gaming machine shown in FIG. 4.

FIG. 7 shows a block diagram of operative components of a gaming device 100 which may be the same as or different to the gaming machine shown in FIG. 4.

The gaming device 100 includes a game controller 101 having a processor 102. Instructions and data to control operation of the processor 102 in accordance with the present invention are stored in a memory 103 which is in data communication with the processor 102.

Typically, the gaming device 100 will include both volatile and non-volatile memory and more than one of each type of memory, with such memories being collectively represented by the memory 103.

Figure 8:
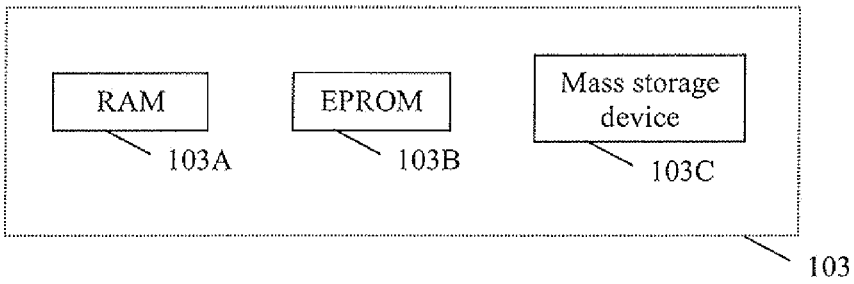
FIG. 8 is a schematic block diagram of components of a memory of the gaming machine shown in FIG. 4.

FIG. 8 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming device has hardware meters 104 for purposes including ensuring regulatory compliance and monitoring player credit, an input/output (I/O) interface 105 for communicating with a player interface 120 of the gaming device 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102. A game play monitor 115 monitors game play data and generates game play data indicative of various aspects of game play.

In the example shown in FIG. 7, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming device 100 includes a communications interface, for example a network card 112. The network card may, for example, send status information, accounting information, game play data or other information to a central controller, rewards controller, server or database and receive data or commands from the central controller, server or database.

It is also possible for the operative components of the gaming device 100 to be distributed, for example input/output devices 106,107,108,109,110,111 may be provided remotely from the game controller 101.

In a thick client embodiment, part of the game played by a player using a gaming device is implemented remotely, for example by a game server, and part of the game is implemented by the gaming device. With this embodiment, as both the game server and the gaming device implement part of the game, they collectively provide a game controller. A database management server may manage storage of game programs and associated data for downloading or access by the gaming devices in a database.

In a variation of the above thick client embodiment, the gaming device is a gaming machine arranged to implement the game, with the game server functioning merely to serve data indicative of a game to the gaming machine for implementation.

With this implementation, a data signal containing a computer program usable by the gaming machine to implement the game may be transferred from the game server to the client terminal, for example in response to a request by the gaming machine.

In a thin client embodiment, the game server implements most or all of the game played by a player using a gaming terminal and the gaming terminal essentially provides only the player interface. With this embodiment, the game server provides the game controller. The gaming terminal will receive player instructions, and pass the instructions to the game server which will process them and return game play outcomes to the gaming terminal for display. In a thin client embodiment, the gaming terminal could be computer terminals, e.g. PCs running software that provides a player interface operable using standard computer input and output components.

Servers are also typically provided to assist in the administration of the gaming system, including for example a gaming floor management server and a licensing server to monitor the use of licenses relating to particular games. An administrator terminal is provided to allow an administrator to monitor the network and the devices connected to the network.

The gaming system may communicate with other gaming systems, other local networks such as a corporate network, and/or a wide area network such as the Internet, for example through a firewall.

Figure 9:
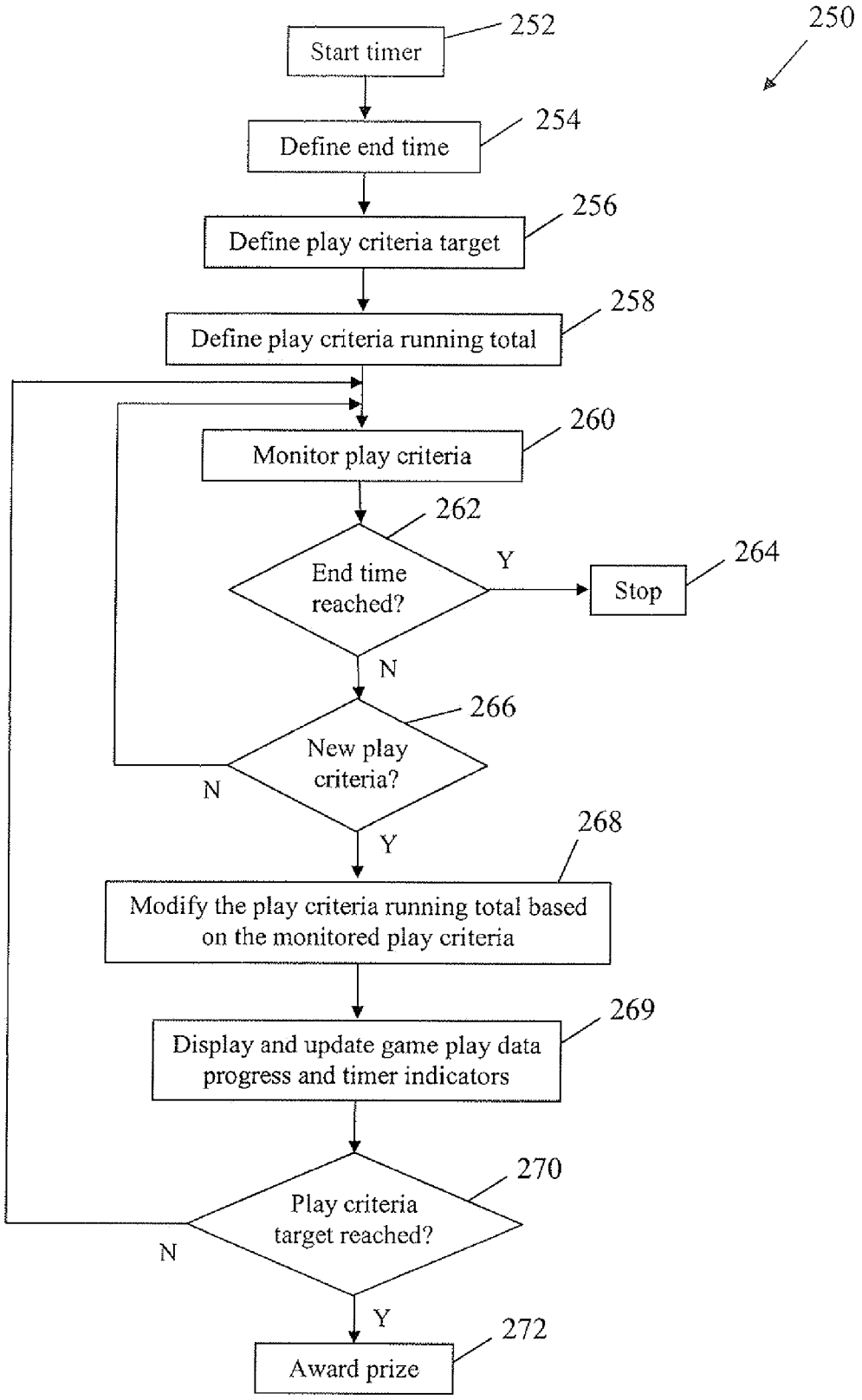
FIG. 9 is a flow diagram illustrating game play of a gaming system in accordance with an embodiment of the present invention.

A specific example will now be described in relation to flow diagram 250 shown in FIG. 9 which illustrates steps 252 to 272 of a method of gaming implemented by the gaming system according to the present embodiment.

In this example, five virtual reels are provided and, as such, representations of the reels are displayed on a graphical display device.

Typically, a player will purchase or otherwise obtain win entitlements such as several win lines which are used in the game to determine win outcomes. If the displayed symbols on the reels have symbols associated with a winning combination such as disposed on a win line, the player wins a prize.

In this example a game play data target is defined for a group of players such that game play data associated with all of the players contributes to the game play data total, and the group of players has a common time limit for reaching the game play data target.

As indicated at steps 252 to 258 of the flow diagram 250, a time limit, a game play data target and a game play running total are first defined and the timer started. Game play activity of players associated with the group of players is then monitored and if new game play data is detected and the time limit has not yet been reached the game play data running total is modified to reflect the new game play activity by the players, as indicated at steps 260 to 268.

The progress of the group of players towards the game play data target is displayed to the players by displaying a game play data progress indicator to the players, for example by displaying the game play data progress indicator on a display of each of the gaming machines currently being played by the players. In addition or alternatively, game play progress indicators may be displayed on a common display disposed at one or more gaming venues, or additionally on other gaming machines not associated with the group of players.

The time available to reach the game play data target is communicated to the group of players by displaying a timer indicator to the players, for example by displaying the timer indicator on a display of the gaming machines currently being played by the players. In addition or alternatively, timer indicators may be displayed on a common display disposed at one or more gaming venues, or additionally on other gaming machines not associated with the group of players.

The game play data progress indicator and the timer indicator are continuously updated as game play data is detected by the respective game play monitors associated with the group of players and to reflect the amount of time available until the time limit is reached, as indicated at step 269.

In the present example, the game play and timer indicators are displayed on a top box of each gaming machine. However, other alternatives are envisaged. For example, the indicators may be displayed on a display of a player marketing module.

If the game play data target is reached before expiration of the time limit, a prize is awarded to the group of players, as indicated at step 272.

It will be understood that the prize awarded may take any suitable form. For example, a prize may comprise show tickets, hotel room bookings, clothing, health club visits, monetary amounts, and so on.

In one particular example, a game play data target of 12,500 points is defined for a group of players associated with a particular class of membership indicative of a particular level of game play loyalty attained, and a time limit of 3 months is defined in which to reach the target. As the players of the group play games on the gaming machines, which may be designated gaming machines or any gaming machines associated with operators of the gaming system, game play data indicative of game play, in this example amount of coin in, is gathered and allocated a number of points. The points are added to a cumulative game play total and if the game play total reaches the game play data target before expiration of the time limit, each member of the group of players wins a prize. In this example, the prize is a hotel room reservation.

Figure 10:
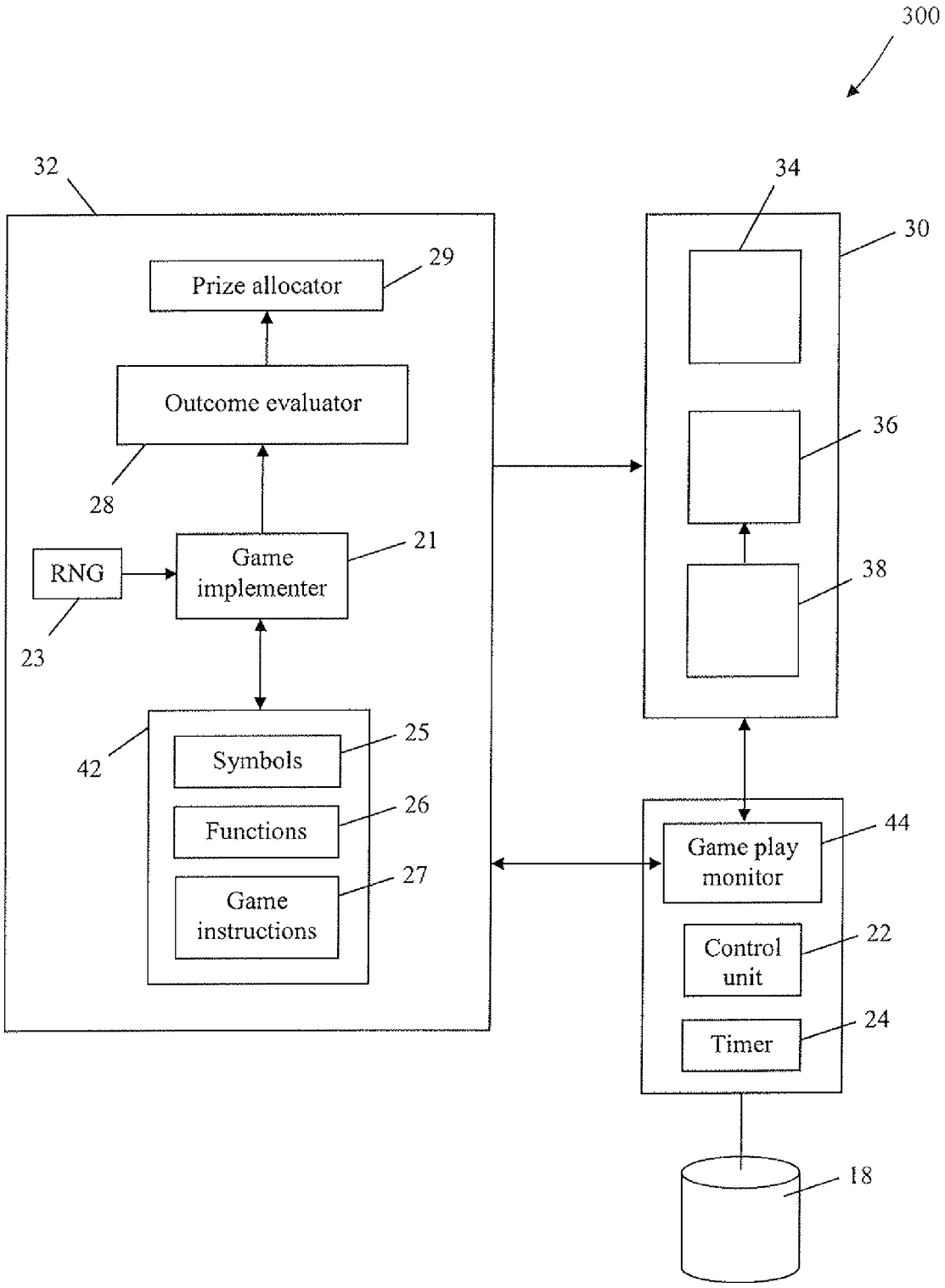
FIG. 10 is a schematic block diagram of functional components of a gaming system in accordance with an alternative embodiment of the present invention.

A functional diagram illustrating operative components of an alternative gaming system 300 is shown in FIG. 10. Like and similar features are indicated with like reference numerals.

Operation of the alternative gaming system 300 is similar to operation of the gaming system 10 shown in FIG. 3. However, with the gaming system 300, instead of providing a reward controller remote from one or more gaming machines, each gaming machine may comprise a reward controller. With this arrangement, each gaming machine will have one or more associated game play data targets such that one or more individual players using the gaming machine have respective associated game play data targets, or each group of players using the gaming machine has an associated game play data target.

It will be understood that a group of players associated with a game play data target may comprise all players associated with the gaming system, all players of one or more designated gaming machines, or all players having a particular membership level indicative of past game play activity.

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

Modifications and variations as would be apparent to a skilled addressee are deemed to be within the scope of the present invention.

The invention claimed is:

1. A gaming system having a plurality of gaming machines, the gaming system comprising:

a first of said gaming machines having 1) a first credit input mechanism configured to permit player interaction to receive a first physical item from a first player representing a first monetary value for establishing a first credit balance, the first credit balance being increasable and decreasable based at least on wagering activity, said first of said gaming machines configured to generate first game play data associated with the first player during game play of a first primary game at the first of said gaming machines in accord with having established the first credit balance via the first credit input mechanism receiving the first physical item, and 2) a first game play monitor configured to monitor the generated first game play data associated with the first primary game of the first player;

a second of said gaming machines having 1) a second credit input mechanism configured to permit player interaction to receive a second physical item representing a second monetary value for establishing a second credit balance, the second credit balance being increasable and decreasable based at least on wagering activity, said second of said gaming machines configured to generate second game play data associated with a second player during game play of a second primary game at the second of said gaming machines in accord with having established the second credit balance via the second credit input mechanism receiving the second physical item, and 2) a second game play monitor configured to monitor the generated second game play data associated with the second primary game of the second player; and a reward controller, having a network interface configured to receive the first game play data associated with the first primary game of the first player from the first of said gaming machines and the second game play data associated with the second primary game of the second player from the second of said gaming machines, the reward controller being configured to maintain a common game play data target of a common game associated with both the first game play data received from the first of said gaming machines and the second game play data received from the second of said gaming machines, to maintain a common game play data total of the common game associated with the first player and the second player, and to contribute both a first value indicative of the first game play data associated with the first player and a second value indicative of the second game play data associated with the second player towards the common game play data total of the common game, wherein game play of the common game is concurrent with the game play of the first primary game and the game play of the second primary game; and an electronic display, coupled to both the first of said gaming machines and the second of said gaming machines, and configured to display:

a graphical progression of the common game play data total graphically progressing towards the common game play data target, wherein the graphical progression of the common game play data total is continuously updated, and a graphical timer configured to visually indicate an amount of time available for the common game play data total to exceed the common game play data target, the graphical timer continuously running during the concurrent game play of the common game, the first primary game, and the second primary game; and wherein said reward controller is further configured to allocate a reward to both the first player and the second player when the common game play data total exceeds the common game play data target before expiration of said time available.

2. The gaming system as claimed in claim 1, wherein the reward controller is locally disposed relative to the first game play monitor.

3. The gaming system as claimed in claim 1, wherein the reward controller is disposed remotely relative to the first game play monitor.

4. The gaming system as claimed in claim 3, wherein the reward controller is in networked communication with the first game play monitor via the network interface.

5. The gaming system as claimed in claim 1, further comprising a progress indicator configured to display the common game play data total.

6. The gaming system as claimed in claim 5, wherein the progress indicator comprises a representation of a thermometer.

7. The gaming system as claimed in claim 1, further comprising a timer configured to maintain the amount of time available displayed at the graphical timer, and wherein said reward controller is further configured to allocate the reward to both the first player and the second player only if a determination is made to allocate the reward before the expiration of the time available.

8. The gaming system as claimed in claim 1, wherein the graphical timer comprises a representation of an analogue and/or digital timer.

9. The gaming system as claimed in claim 1, wherein said electronic display is disposed on a top box of the second gaming machine.

10. The gaming system as claimed in claim 1, wherein the second gaming machine further comprises a player marketing module.

11. The gaming system as claimed in claim 1, wherein the first player has an associated first game play data total and a first game play data target, and the second player has an associated second game play data total and a second game play data target.

12. The gaming system as claimed in claim 1, wherein the common game play data total is a group current game play data total of a group of players and the common game play data target is a group game play data target of the group of players.

13. The gaming system as claimed in claim 12, wherein the group of players is defined according to at least one of a location, a type of gaming machines played, and a designated membership level.

14. The gaming system as claimed in claim 1, wherein the common game play data target is a group game play data target, and both the first player has an associated first game play data total and the second player has an associated second game play data total accumulating to the common game play data total.

15. The gaming system as claimed in claim 1, wherein the game play data comprises at least one of a total amount of coin in, coin loss, game points earned and a velocity of play.

16. The gaming system as claimed in claim 1, wherein the reward comprises at least one of show tickets, hotel room bookings, clothing, health club visits and monetary amounts.

17. The gaming system as claimed in claim 1, further comprising an outcome evaluator configured to evaluate an outcome based on the wager.

18. A method of gaming for use with a plurality of gaming machines, a network interface, and a gaming controller, a first of said gaming machines having 1) a first credit input mechanism configured to permit player interaction to receive a first physical item from a first player representing a first monetary value for establishing a first credit balance, the first credit balance being increasable and decreasable based at least on wagering activity, said first of said gaming machines configured to generate first game play data associated with the first player during game play of a first primary game at the first of said gaming machines in accord with having established the first credit balance via the first credit input mechanism receiving the first physical item, and 2) a first game play monitor, and a second of said gaming machines having 1) a second credit input mechanism configured to permit player interaction to receive a second physical item representing a second monetary value for establishing a second credit balance, the second credit balance being increasable and decreasable based at least on wagering activity, said second of said gaming machines configured to generate second game play data associated with a second player during game play of a second primary game at the second of said gaming machines in accord with having established the second credit balance via the second credit input mechanism, and 2) a second game play monitor, the method comprising:

monitoring via said first game play monitor the generated first game play data associated with the first primary game of the first player from the first of said gaming machines;

monitoring via said second game play monitor the generated second game play data associated with the second primary game of the second player from the second of said gaming machines;

receiving via the network interface the first game play data associated with the first primary game of the first player from the first of said gaming machines;

receiving via the network interface the second game play data associated with the second primary game of the second player from the second of said gaming machines;

maintaining via said gaming controller a common game play data target of a common game associated with both the game play data received from the first of said gaming machines and the second game play data received from the second of said gaming machines;

maintaining via said gaming controller a common game play data total of the common game associated with both the first player and the second player;

contributing via the game controller both a first value indicative of the first game play data associated with both the first player and a second value indicative of the second game play data associated with the second player towards the common game play data total of the common game, wherein game play of the common game is concurrent with the game play of the first primary game and the game play of the second primary game;

displaying, at an electronic display coupled to both the first of said gaming machines and the second of said gaming machines, both of:

a graphical progression of the common game play data total graphically progressing towards the common game play data target, wherein the graphical progression of the common game play data total is continuously updated, and a graphical timer configured to visually indicate an amount of time available for the common game play data total to exceed the common game play data target, the graphical timer continuously running during the concurrent game play of the common game, the first primary game, and the second primary game; and allocating a reward to each of the first player and the second player when the common game play data total exceeds the common game play data target before expiration of said time available.

19. The method as claimed in claim 18, wherein displaying the game play data total comprises displaying the common game play data total via a progress indicator.

20. The method as claimed in claim 19, wherein the progress indicator comprises a representation of a thermometer.

21. The method as claimed in claim 18, further comprising maintaining the amount of time available that is displayed at the graphical timer and allocating the reward to both the first player and the second player only if a determination is made to allocate the reward before expiration of the time available.

22. The method as claimed in claim 18, wherein the graphical timer comprises a representation of an analogue and/or digital timer.

23. The method as claimed in claim 18, further comprising providing each player with an associated second game play data total and providing each player with a second game play data target.

24. The method as claimed in claim 18, further comprising forming a group of players with the first player and the second player, and wherein the common game play data total is a group current game play data total of the group of players and the common game play data target is a group game play data target of the group of players.

25. The method as claimed in claim 24, further comprising defining the group of players according to at least one of a location, a type of gaming machines played, and a designated membership level.

26. The method as claimed in claim 18, further comprising forming a group of players with the first player and the second player, and wherein the common game play data target is a group game play data target and providing both the first player with an associated first game play data total and the second player with an associated second game play data total contributing to the common game play data total.

27. The method as claimed in claim 18, wherein the game play data comprises at least one of a total amount of coin in, coin loss, game points earned and a velocity of play.

* * * * *